United States Patent [19]

Silcox et al.

[11] 4,297,095

[45] Oct. 27, 1981

[54] FILAMENT WINDING APPARATUS

[75] Inventors: David R. Silcox, Gainesville; John L. Doster, Oakwood, both of Ga.

[73] Assignee: RCA Corporation, New York, N.Y.

[21] Appl. No.: 116,260

[22] Filed: Jan. 28, 1980

[51] Int. Cl.[3] ..... F27B 9/28; B65H 54/20; B65H 54/42

[52] U.S. Cl. ..... 432/59; 28/281; 34/60; 34/61; 242/18 DD; 242/35.5 R

[58] Field of Search ..... 242/35.5 R, 18 DD, 18 R; 28/281; 432/59; 34/60, 61

[56] References Cited

U.S. PATENT DOCUMENTS

| | | | |
|---|---|---|---|
| 910,415 | 1/1909 | Pohl | 242/35.5 R |
| 916,388 | 3/1909 | Clark | 242/35.5 R |
| 3,016,205 | 1/1962 | Barnes, Jr. | 242/18 DD |
| 3,235,192 | 2/1966 | Scragg | 242/35.5 R |
| 3,350,021 | 10/1967 | Marciniak | 242/35.5 R X |
| 3,774,384 | 11/1973 | Richter | 28/281 X |
| 3,830,440 | 8/1974 | Bense | 242/35.5 R |
| 3,972,176 | 8/1976 | Lawson, Jr. et al. | 28/281 |
| 4,015,314 | 4/1977 | Hurst et al. | 242/18 R X |
| 4,036,446 | 7/1977 | Schar | 242/18 DD X |
| 4,157,793 | 6/1979 | Lucia | 242/35.5 R |

FOREIGN PATENT DOCUMENTS

| | | | |
|---|---|---|---|
| 2403718 | 7/1975 | Fed. Rep. of Germany | 242/35.5 R |
| 990836 | 6/1951 | France | 242/35.5 R |
| 442650 | 2/1936 | United Kingdom | 242/35.5 R |

*Primary Examiner*—Stanley N. Gilreath
*Attorney, Agent, or Firm*—Samuel Cohen; William Squire

[57] ABSTRACT

A filament winding apparatus useful, for example, with a machine for heat setting filaments for tufted textile materials, such as carpeting. The apparatus includes two winding headers which are operated in synchronism for concurrently receiving two filaments from the heat setting machine and a tension device for applying uniform tension on both filaments as they leave the heat setting machine. A timing belt provides synchronism between the two winding headers and an anti-slip drive apparatus insures positive engagement of the drive rollers with the winding spindles in each header during the winding operation.

9 Claims, 6 Drawing Figures

FILAMENT WINDING APPARATUS

The present invention relates to apparatus for winding filaments.

Winding apparatus useful with a heat setting machine includes a winding spindle above a drive roller which rotates the spindle by friction engagement with the spindle. A spool on which the filament is to be wound is placed over the spindle and is frictionally engaged with the drive roller which rotates the spool causing it to take up and wind thereon the filament from the heat setting machine. Present heat setting machines and winding apparatus used in conjunction therewith wind single strands of filament. The filament may be a single strand or multiple strand yarn such as used in carpet.

It is desirable to increase the capacity of the heat setting machine by processing more than one filament simultaneously. However, such simultaneous operation requires winding apparatus to wind the filaments simultaneously. Attempts have been made to use two winding headers at a single station to wind two filaments from the heat setting machine simultaneously, however, they have met with little success. The problem is that the filaments often break as they are being wound. To avoid such breakage, the rate of processing the yarn in the heat setting machine must be slowed. Overall, while the capacity of the heat setting machine is increased over the single filament configuration, the percentage of increase in capacity is not commensurate with the added expense of the additional winding apparatus.

A filament winding apparatus according to the present invention includes filament tension control means for simultaneously receiving a plurality of filaments to be wound and for providing substantially identical tension on each received filament. Winding means are provided which include means for receiving a like plurality of filament receiving spindles for simultaneously winding each of the filaments on a separate different corresponding spindle. The winding means include a like plurality of friction drive means for rotating each of the filament spindles by frictional engagement with the outer surface of the windings during the winding. Means are included for urging the friction drive means in continuous engagement with the windings outer surface. Timing means synchronously rotate each of the plurality of friction drive means.

Figure 1:
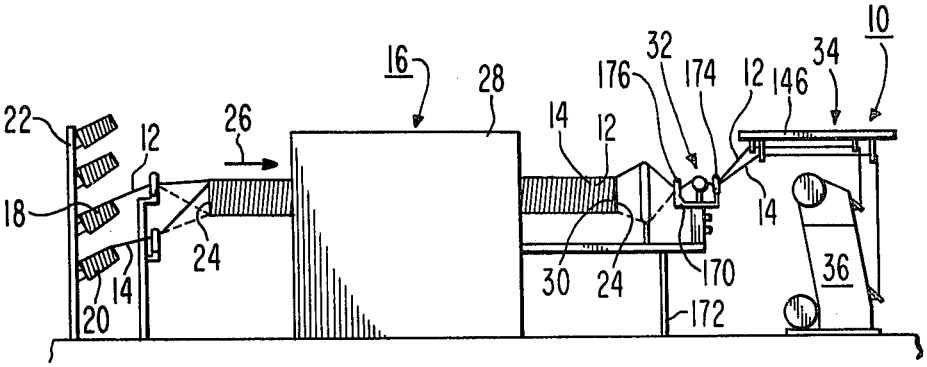
FIG. 1 is a side elevational view of a filament heat setting and winding system embodying the present invention.

Referring first to FIG. 1, the heat setting apparatus 16 conventionally receives at a single station, a single multistrand cord, hereafter termed a filament, for processing and then for take up by a single winding apparatus. In a system embodying the invention, the feed station is arranged to supply two separate filaments 12 and 14, from spools 18 and 20, respectively, to a single station of the heat setting machine 16, and thence to a single modified form of winding station 10, such as will be described. The filaments are wound concurrently on separate spools at the winding station 10 thereby increasing the throughput of the heat setting apparatus by a factor of almost two without substantially increasing the floorspace required for the system.

At the input end of the machine 16, the filaments 12 and 14 are wound, in bifilar fashion, on a core 24 which is part of the heat set apparatus 16. Core 24 comprises a set of ropes mounted on pulleys (not shown) which are moved in direction 26 through an oven 28. The filaments 12 and 14 are relatively loosely wound about the core 24 to permit hot air circulation within the oven 28 to heat set the filaments. The apparatus 16 including the core 24 is conventional and is commercially available; however, when used in the conventional way, it processes only a single filament on core 24. The core 24 moves the filaments that are wound thereabout through the oven 28 exiting at location 30 from the oven 28.

At 30, the filaments 12 and 14 pass from the core 24 through a tension control apparatus 32 thence through a guide apparatus 34 on the winding apparatus 10. The filaments 12 and 14 are then simultaneously wound by the winding assembly 36.

The heat setting apparatus 16 imparts certain characteristics to the filaments 12 and 14, which may be nylon yarn or other materials, by uniformly raising the temperature of the filaments. This requires hot air to be in contact with all surfaces of each filament. This is the reason for relatively loosely winding the filaments about a rope type core 24 which allows the hot air to circulate fully around each filament.

As each of the spools 18, 20 on the rack 22 supplying the filaments to the core 24 empties, an operator ties the end of the filaments on the core 24 to adjacent full spools so that the process is relatively continuous for many hours. The number of filaments of a given diameter that can be wound on the core 24 at a given processing rate is limited by the requirement for heat circulation to impart the desired heat setting characteristics to the filaments. That is, if a relatively large number of filaments of a given diameter, i.e., a 2 ply 3's yarn (a given weight for 120 yard length) or a 2 ply 1350-BCF filament yarn, were wound about the core 24, i.e., four or more, they could block the heat circulation for a given processing rate, i.e., 800 meters per minute from within the core, which is hollow, and this would result in non-uniform heat setting of the filaments. At present, the heat setting of two contiguous side by side filaments using a 3's yarn or 1350 BCF, 2 plies each, simultaneously on such an apparatus does provide satisfactory heat setting characteristics. These filaments or yarns are wound about core 24 at $2\frac{1}{2}$ windings per centimeter of length of core. For this reason, the winding apparatus 10 described later, is illustrated as winding two filaments or yarns simultaneously. The apparatus can be modified to wind more than two filaments by increasing the temperature and feed rate. In any case, the filaments should not overlap on the core 24 and should always lie on a single layer. Additional winding means to be described may be added to such a machine to wind three or even more filaments simultaneously depending on the factors described above.

The oven 28 of the heat setting apparatus 16 is a relatively large apparatus and accommodates six cores 24 in a row into the drawing of FIG. 1 forming six separate heat setting stations. Winding apparatus 10 also includes six sets of winding apparatus in a row, also into the drawing of FIG. 1. The apparatus to be described later will be concerned with the winding apparatus that is present at a single station. Of course the number of stations depends on the size of the oven 28 and the number of cores 24 in a given implementation.

In FIG. 1 the winding apparatus 10 and the tension control apparatus 32 cooperate to wind the pair of filaments 12 and 14 simultaneously without breakage at the full designed processing rate of the heat setting apparatus 16, e.g., 800 meters/minute. This is important because the winding apparatus in this manner does not interfere with the heat setting rate of the apparatus 16 while at the same time almost doubles the capacity of the apparatus 16 without increasing the speed or altering the heat set portion of apparatus 16.

Figure 2:
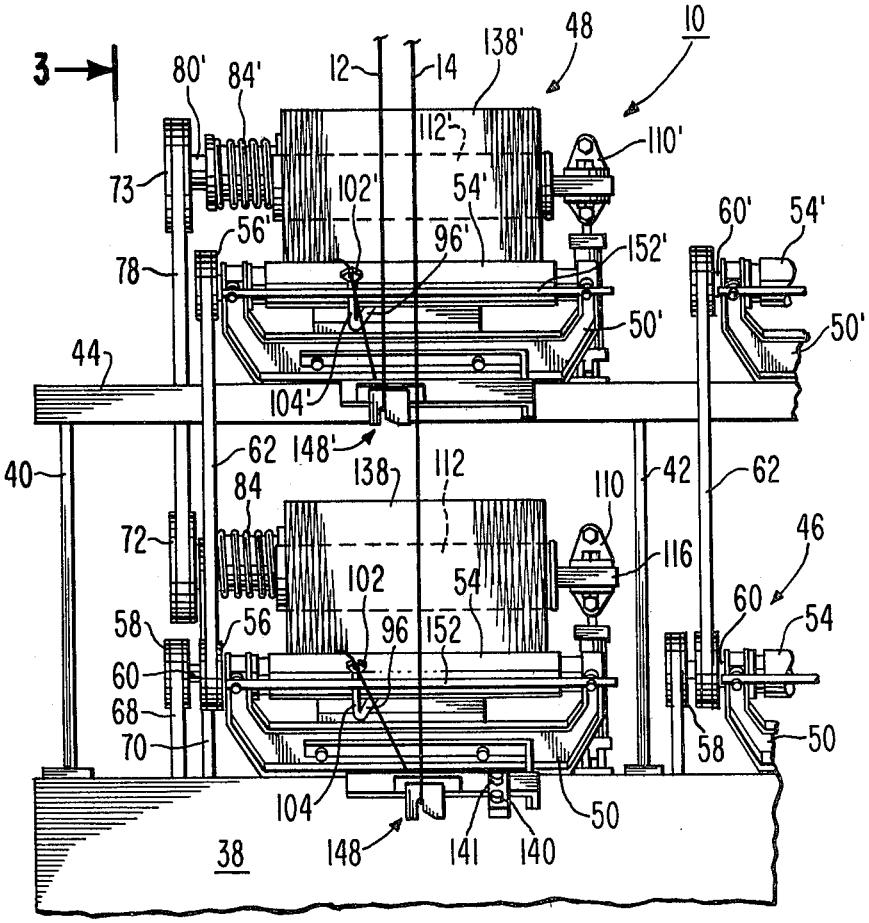
FIG. 2 is a front elevation view of the winding apparatus of FIG. 1.

In the description which follows of the winding apparatus 10, FIGS. 2–5 should be referred to. In FIG. 2 apparatus 10 includes a base 38 on which are secured an array of upstanding supports 40, 42. While only two such supports are shown, to the right of the drawing there are, in practice, five additional like supports. Also not shown are five additional winding stations, only one station being shown in FIG. 2. The winding stations are aligned in a row. Each station operates independently of the other station, but all are substantially the same as the station of FIG. 2 and include similar apparatus. Therefore, the description of the station of FIG. 2 is sufficient to describe all six stations. Upstanding supports 40 and 42 and other supports (not shown) aligned with supports 40 and 42 to the right of the drawing on the base 28 support a horizontally extending channel beam 44.

Figure 3:
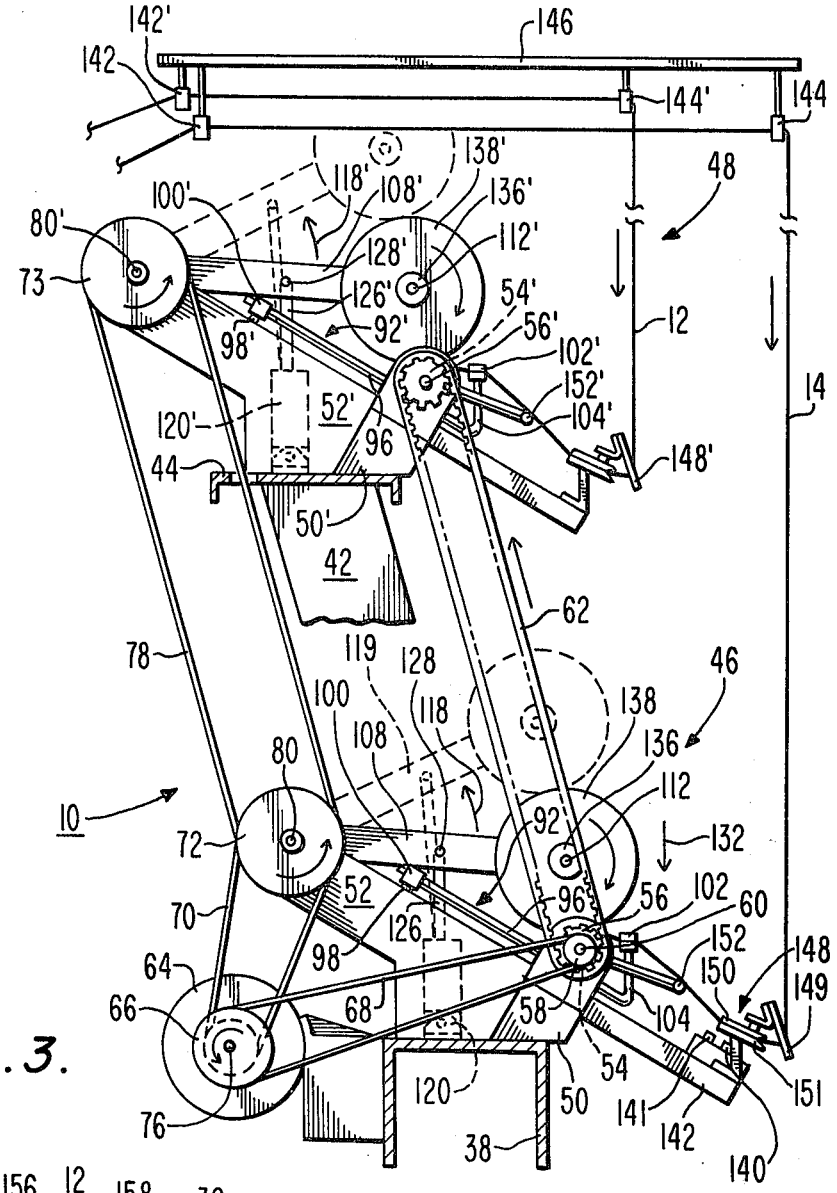
FIG. 3 is a side elevation sectional view of the winding apparatus of FIG. 2.

Secured to base 38 is lower winding assembly 46. Directly above the winding assembly 46 and slightly to the rear as shown in FIG. 3 is winding assembly 48. Except for the necessary apparatus to connect the winding assembly 46 to a primary power source, the assemblies 46 and 48 are substantially the same. For this reason, like numerals in assemblies 46 and 48, refer to like parts, with the numerals of assembly 48 being primed. While assembly 46 will be described, reference to assembly 48 and its parts with like numerals will illustrate its construction as well. Assembly 48 is secured to beam 44. While assembly 48 is slightly to the rear of assembly 46, they are otherwise aligned with each other to the left and right of the drawing of FIG. 2.

In FIGS. 2 and 3 lower assembly 46 includes a yoke frame 50 which is bolted to the front of housing 52, which is bolted to base 38. Housing 52′ of assembly 48 is bolted to beam 44. Drive roller 54 is rotatably mounted to yoke 50. Timing pulley 56 and a drive pulley 58 are secured to shaft 60 which is connected to drive roller 54. Pulley 56 has teeth which receive the teeth of timing belt 62 which is connected to the toothed pulley 56′ of assembly 48. In FIG. 3 pulley 58 is driven by motor 64 via drive shaft 76, pulley 66 and drive belt 68. Motor 64 is secured to base 38. The timing belt 62 mates with the teeth of the driven pulleys 56 and 56′ on assemblies 46 and 48, respectively, for synchronously driving rollers 54 and 54′.

Figure 4:
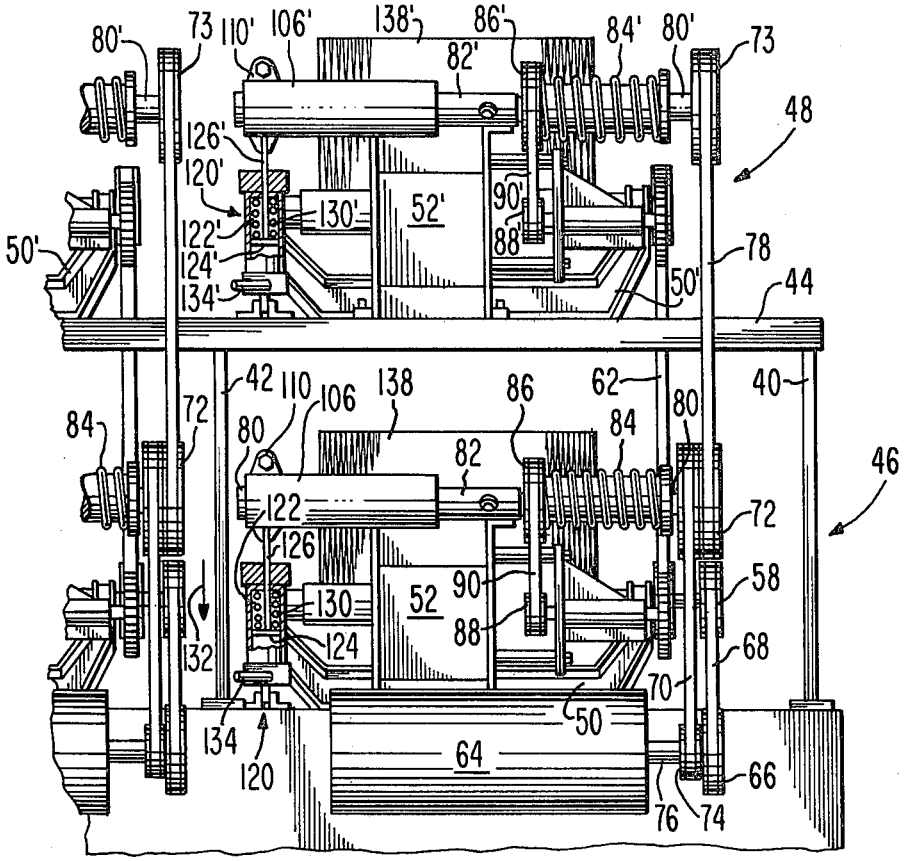
FIG. 4 is a rear elevation view of the apparatus of FIG. 2.

In FIG. 4, motor 64 drives sheave 72 via belt 70 and pulley 74 on shaft 76. Sheave 72 rotates pulley 73 via belt 78. Sheave 72 is mounted on shaft 80 which is rotatably secured in sleeve 82. Sleeve 82 is bolted to housing 52 and provides a bearing support for shaft 80.

Also mounted on shaft 80 is a spring 84 and a split pulley 86. Pulley 86 is rotatably driven by belt 70 and sheave 72. Pulley 86 is connected to and rotatably drives eccentric pulley 88 with belt 90. Pulley 88 is connected to an internal mechanism (not shown) within housing 52 for driving filament guide assembly 92, FIG. 5, in directions 94. The eccentric pulley 88 applies a variable tension to belt 90 due to the pulley's eccentricity. This tension causes the split halves of pulley 86 to separate different amounts which changes the effective pulley diameter with respect to belt 90. Spring 84 compresses the halves of pulley 88 together and determines the amount of tension required to separate the halves of pulley 86. The variation of separation of the two pulley halves determines the effective pulley diameter. The varying pulley diameters changes the rate of rotation of pulley 88. Guide assembly 92 is operated at different rates as will be explained later by pulley 88 to prevent uneven laying of the filaments on the spool during winding.

Figure 5:
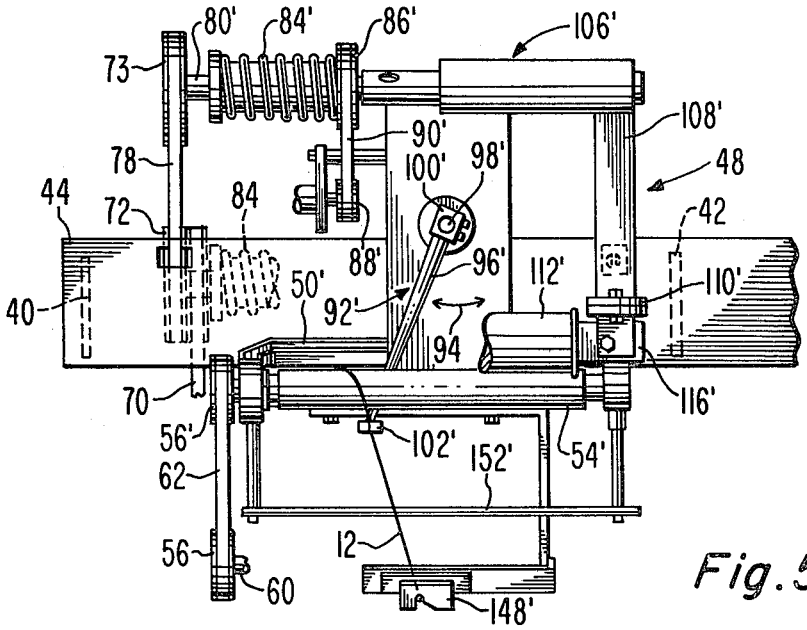
FIG. 5 is a plan view of the apparatus of FIG. 2.

In FIG. 5 guide assembly 92′ of assembly 48 comprises an elongated rod 96′ which is connected to drive shaft 98′ at one end by connector 100′. At the other end of rod 96′ is a filament guide 102′. In FIG. 3, guide 102 is on the upstanding end of leg 104. Guide assemblies 92 and 92′ operate similarly.

In FIG. 4, right angle arm 106 is rotatably mounted on shaft 80 on the other side of sleeve 82 from pulley 86. Arm 106 is retained on the shaft 80 by a retaining device (not shown). In FIG. 5 arm 106′ of assembly 48 includes a leg 108′ having a flange 110′ at the extended end thereof. A spindle 112′ is pivotally mounted to support 116′ which in turn is bolted to flange 110′. Spindle 112′ receives an empty spool (not shown) on which a filament is to be wound. The wound filaments are not shown in FIG. 5 for simplicity of illustration. The wound spools are illustrated in FIGS. 2, 3 and 4 on the assemblies at 138 and 138′. In FIG. 3, leg 108 of arm 106 is pivoted in direction 118 about shaft 80. The movement of leg 108 is independent of the rotation of the shaft 80. The position of the leg 108 when moved in direction 118 is shown dashed at 119.

In FIG. 4 arm 106 is rotated on shaft 80 by piston device 120. Device 120 includes a piston housing 122 in which there is a piston 124. Piston rod 126 is pivotally connected to leg 108 (FIG. 3) at pivot pin 128. Compression spring 130 forces the piston 124 in the downward direction 132. Conduit 134 supplies pressurized air from a source (not shown) to the piston housing 122 interior to force the piston 124 and leg 108 in the upward direction 118 (FIG. 3).

The spring 130 within piston device 124 maintains the leg 108, FIG. 3, in its lowermost position as illustrated. This urges the spindle 112 in the direction 132, forcing the spool 136 mounted on the spindle 112 in the downward direction so that the winding 138 thereon bears against drive roller 54 and is maintained in continuous friction contact therewith. The same holds for the corresponding structure 54′ and 138′ so that the two spools 136 and 136′ and their respective windings 138 and 138′ are driven in synchronism, without slippage between them, and with the filaments running at the same speed (the surface speed of the two windings will be the same). That is, springs 130 and 130′ of the pistons 120 and 120′, respectively, continuously urge filament windings 138 and 138′, respectively, in friction engagement with the drive rollers 54 and 54′ and timing belt 62 provides a synchronous rotation of the drive rollers 54 and 54′ so that both windings are driven at the same surface speed (even if one spool should not be as full as the other).

When it is desired to place the windings on a spindle 112, the operator presses a control button 140, FIG. 3, mounted on a bracket 142 secured to yoke frame 50. This stops motor 64 and supplies air pressure to the piston devices 120 and 120', raising the spindles 112 and 112' in the upward direction to the position 119, 119' shown dashed. The operator then may remove the windings 138 and 138' from respective spindles by sliding them off to the left of the drawing, FIG. 2. Empty spools are then placed over the spindles 112 and 112'. Control button 141 is then pressed removing the air pressure from piston devices 120 and 120' resulting in the springs 130 and 130' lowering the spindles and the spools in friction engagement against the drive rollers 54 and 54'.

In FIG. 3, filament 14 is supplied from the tension control apparatus 32, FIG. 1, through guides 142 and 144 on overhead support 146 to a tension assembly 148. Tension assembly 148 comprises a plurality of plates 149, 150 and 151, which guide and apply frictional sliding resistance to the filament 14 as it is being wound on spool 136. The filament 14 is supplied from the tension assembly 148 over a guide rod 152 which is mounted to the yoke frame 50. Filament 14 passes over the rod 152 and through the guide 102 on guide assembly 92 as it oscillates in directions 94, FIG. 5. The oscillations are at different rates due to the split pulley 86 action described above. In a similar manner, filament 12 is fed through tension assembly 148', which is constructed similarly as assembly 148. The filaments 12 and 14 are supplied from the core 24 at the exit location 30 of the heat set apparatus 16 through the tension control apparatus 32.

Figure 6:
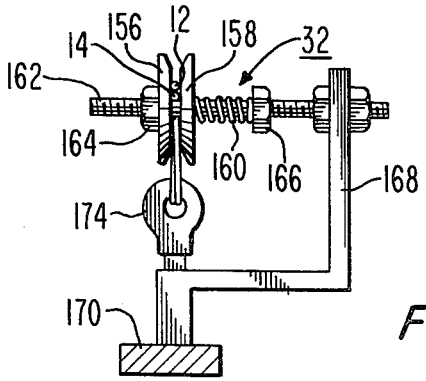
FIG. 6 is an end elevation view of a tension control apparatus used in the system of FIG. 1.

As shown in FIG. 6, tension control apparatus 32 comprises a pair of opposing plates 156 and 158 which are urged together by compression spring 160. Plate 156 is retained to bolt 162 by a nut 164 while the compression spring 160 is retained by nut 166 on bolt 162. The bolt 162, in turn, is fastened to bracket 168 mounted on support 170. Support 170, in turn, is mounted on a framework 172, FIG. 1. Also mounted on the bracket 168 are a pair of guides 174 and 176, FIG. 1. Guide 174 is between tension device 32 and winding apparatus 10, while guide 176 is between the heat set apparatus 16 and the tension control apparatus 32. Plates 156 and 158 provide almost identical tension on filaments 12 and 14 due to the identity in diameter of the filaments 12 and 14.

In operation, in FIG. 1, the filaments 12 and 14 are continuously supplied through the guide 176, tension apparatus 32 and guide 174 to the winding apparatus 10. After leaving guide 174, the filaments pass through the guides on the support 146 shown also in FIG. 3. Referring now to FIG. 3 the filaments then pass through the tension assemblies 148 and 148'. Assume that the operator has just stopped the winding process, raised the filled spools to the dashed line positions and removed them after cutting the filaments. She then replaces the removed spools with empty spools and attaches the filaments 12 and 14 to the empty spools 136 and 136', respectively, on the spindles 112 and 112'. The operator than presses button 141 which removes the air pressure from piston devices 120 and 120' simultaneously lowering the spools 136 and 136' into friction engagement with drive rollers 54 and 54', respectively. The motor 64 is operated by button 141, also. The operation of motor 64 oscillates the guide assembly 92 on winding assembly 46 and the guide assembly 92' on the winding assembly 48. The guide assemblies 92 and 92' move the filaments uniformly over the length of the spools. The timing belt 62 drives the drive rollers 54 and 54' in synchronism and the frictional engagement of the spools with the driver rollers due to the piston devices 120 and 120' insures synchronous driving action of the two spools. The speed of rotation of the spools is synchronized with the feed of the filaments at location 30 from the heat set assembly 16, FIG. 1. While there may be some minute variations in surface speed between the spools 136 and 136', any variation in take up of the filaments 12 and 14 does not cause slack to occur between the tension control apparatus 32 of FIG. 1 and the winding apparatus 10. That is, unless a positive tension is placed on the filaments 12 and 14, the filaments may break. The tension apparatus 32 prevents slack from occurring in the filament between the corresponding spools and the heat set apparatus at location 30. This lack of slack has been determined to be important in that it prevents breakage in the filaments which might otherwise occur. Also, it is essential that the spools be maintained in continuous frictional engagement with the drive rollers to prevent slippage. Any slippage between one roller and the other will result in slack building up between that spool and the tension apparatus 32. Such slack will result in excessive tension on the other filament causing it to break. Thus, even though both spools are driven in synchronism by belt 62, FIG. 3, if there is any slippage between the drive roller and the winding, then synchronism will be lost. This is not acceptable as such loss of synchronism will break the filament. As described above, the springs 130 and 130' in devices 120 and 120' continuously resiliently urge the spools of windings in frictional engagement with the drive rollers 54 and 54' insuring that negligible slippage does, in fact, occur. Winding assemblies 46 and 48 are separately manufactured and are commercially available without the timing belt and connecting time pulleys, the connecting drive belt 78 and its associated pulleys, as model GF-10R Gilbos Heads, manufactured by the Gilbos Company of Belgium. Heat setting apparatus 16 is a commercially available machine manufactured by the Suessen Company. Prior to the present invention it was not possible to combine multiple Gilbos winding heads with the Suessen heat setting machine and obtain the efficiency of the present invention.

While two filaments are illustrated in the present embodiment, it will be apparent that more than two filaments may be used for a particular filament processing apparatus in which more than two filaments can be processed by that apparatus. Preferably, two yarns as used in the tufting industry are the optimum number of filaments which can be used by the Suessen heat setting machine. It will be apparent, however, that if such a machine could process more than two yarns, then a corresponding increased number of winding heads such as assemblies 46 and 48 may be added to the present winding apparatus in a stacked arrangement to wind such additional yarns or filaments.

What is claimed is:

1. A filament winding apparatus comprising:

means for transporting a plurality of filaments wound side by side about a moving core, each filament being in contact with said core, means for heat setting said filaments during said transporting, adjustable filament tension control means for simultaneously receiving said plurality of filaments from said means for transporting and for applying substantially identical tension to each of said received filaments during the time the filaments are being wound by the winding means set forth below, said tension control means including a pair of facing members and means for adjustably resiliently urging said members together, the facing surfaces of said members receiving said filaments therebetween, each said facing surface being in contact with each filament, and winding means including means for receiving a like plurality of filament receiving spools for simultaneously winding each of said filaments on a different spool, said winding means including a like plurality of friction drive means, each drive means for rotating a corresponding spool by frictional engagement with the outer surface of the windings on the spool, means for urging each friction drive means into continuous engagement with the outer surface of its corresponding spool with negligible slippage between said friction drive means and said outer surface, and timing means for synchronously rotating each of said plurality of, friction drive means.

2. The apparatus of claim 1 wherein said means for urging includes means for resiliently urging said drive means in said engagement.

3. The apparatus of claim 2 wherein said means for urging includes piston means for separating said drive means out of said engagement.

4. The apparatus of claim 1 wherein said means for urging includes hydraulically operated piston means.

5. The apparatus of claim 1 wherein said winding means includes a plurality of sets of winding means each set comprising a filament receiving spindle, a drive means, and a means for urging, said sets being arrayed in stacks, one set above the other set.

6. The apparatus of claim 5 wherein said timing means includes timing belt means connected to the drive means of each set.

7. In a yarn processing apparatus including means for winding two yarns in bifilar fashion about a core in a continuous process, said core continuously moving in a given direction, means for processing said yarns while moving in said direction, the bifilar yarn on said core after being processed being removed from the core and wound on separate, different spools, a yarn winding apparatus for winding said processed yarn from said core comprising:

a pair of stacked like winding means for winding, one above the other, the yarns on said spools, and tension means between said winding means and said core for providing substantially identical tension on said yarns while they are being wound by said winding means, each said winding means including means for rotationally frictionally driving its corresponding spool of yarn at an outer yarn surface speed which is in synchronism with the outer yarn surface speed of the other spools, said winding means including means for causing said means for frictionally driving each said winding means to simultaneously engage said outer surfaces of each spool, said tension means comprising a pair of facing members and means for resiliently urging said facing members together.

8. A system for processing filaments comprising, in combination:

a heat setting machine having at least one station with an input end and an output end;

means for concurrently feeding at least two filaments into said machine at the input end of said station for heat treatment by the machine, said means including a common conveyor on which both filaments are bifilar wound for carrying both filaments through the machine at the same speed while they are being subjected to said heat treatment;

adjustable passive tension means at the output end of said station for concurrently applying substantially equal tension to each of said filaments as they are being withdrawn from said heat setting machine during the time the filaments are being wound by the take-up means set forth below, said tension means comprising a pair of facing members and means for resiliently urging the members together for receiving each of the filaments therebetween;

two take-up spools to which the two filaments are respectively attached for takeup by said spools; and means for concurrently frictionally driving said spools at the same surface speed.

9. A system as set forth in claim 8 wherein said common conveyor comprises a plurality of ropes forming an elongated, hollow core which, in operation, moves through the heat setting machine, and wherein said means for concurrently feeding comprises means for winding said at least two filaments on said core in bifilar fashion, as the core moves.

* * * * *

UNITED STATES PATENT AND TRADEMARK OFFICE
CERTIFICATE OF CORRECTION

PATENT NO. : 4,297,095

DATED : October 27, 1981

INVENTOR(S) : David R. Silcox et al.

It is certified that error appears in the above-identified patent and that said Letters Patent is hereby corrected as shown below:

Column 5, line 61, "than" should be --then--.

Column 7, line 34, "spindle" should be --spool--.

Column 7, line 35, after "for" insert --simultaneous--.

Signed and Sealed this

*Twenty-third* Day of *February 1982*

[SEAL]

*Attest:*

GERALD J. MOSSINGHOFF

*Attesting Officer*

*Commissioner of Patents and Trademarks*